US007068218B2

(12) United States Patent
Göttl et al.

(10) Patent No.: US 7,068,218 B2
(45) Date of Patent: Jun. 27, 2006

(54) CALIBRATION DEVICE FOR AN ANTENNA ARRAY, ANTENNA ARRAY AND METHODS FOR ANTENNA ARRAY OPERATION

(75) Inventors: Maximilian Göttl, Frasdorf (DE); Roland Gabriel, Griesstätt (DE); Jörg Langenberg, Prien (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 10/455,786

(22) Filed: Jun. 6, 2003

(65) Prior Publication Data

US 2004/0032365 A1 Feb. 19, 2004

(30) Foreign Application Priority Data

Aug. 19, 2002 (DE) ..... 102 37 823

(51) Int. Cl.
*H01Q 3/22* (2006.01)

(52) U.S. Cl. ..... 342/368; 342/375

(58) Field of Classification Search ..... 342/165, 342/173, 174, 368, 371, 374, 375
See application file for complete search history.

(56) References Cited

U.S. PATENT DOCUMENTS

| | | | | |
|---|---|---|---|---|
| 5,086,302 | A | 2/1992 | Miller | |
| 5,151,706 | A | 9/1992 | Roederer et al. | |
| 5,276,452 | A * | 1/1994 | Schuss et al. | 342/371 |
| 5,502,447 | A * | 3/1996 | Kumpfbeck et al. | 342/373 |
| 5,644,316 | A | 7/1997 | Lewis et al. | |
| 5,784,030 | A | 7/1998 | Lane et al. | |
| 5,784,031 | A | 7/1998 | Weiss et al. | |
| 5,936,569 | A | 8/1999 | St.ang.hle et al. | |
| 6,043,790 | A * | 3/2000 | Derneryd et al. | 343/853 |
| 6,046,697 | A | 4/2000 | Overbury et al. | |
| 6,081,233 | A | 6/2000 | Johannisson | |
| 6,133,868 | A | 10/2000 | Butler et al. | |
| 6,222,486 | B1 | 4/2001 | Flacke et al. | |
| 6,351,243 | B1 | 2/2002 | Derneryd et al. | |
| 6,417,804 | B1 * | 7/2002 | Merlet et al. | 342/368 |
| 6,426,726 | B1 * | 7/2002 | Yablon | 343/754 |
| 6,515,616 | B1 | 2/2003 | Kuplicki | |
| 6,642,908 | B1 * | 11/2003 | Pleva et al. | 343/876 |
| 6,647,276 | B1 | 11/2003 | Kuwahara et al. | |
| 6,680,698 | B1 * | 1/2004 | Eiges | 342/373 |
| 6,771,216 | B1 * | 8/2004 | Patel et al. | 342/368 |

FOREIGN PATENT DOCUMENTS

DE 692 00 720 T2 4/1995

(Continued)

OTHER PUBLICATIONS

Peik, S. F. et al., "High-Temperature Superconductive Butler Matrix Beamformer for Satellite Applications," pp. 1543-1546, 1999 IEEE MIT-S Digest (1999).

(Continued)

*Primary Examiner*—Dao Phan
(74) *Attorney, Agent, or Firm*—Nixon & Vanderhye P.C.

(57) ABSTRACT

An improved calibration device for an antenna array, or an improved antenna array, is of simple construction. If the total number of antenna elements which are provided for a column is N, where N is a natural number, only N/2 or less coupling devices and/or probes are provided, the number of couplers or probes which are provided are associated with only some of the antenna elements; and a combination network is also provided, via which the coupling devices and/or probes which are provided are connected.

13 Claims, 5 Drawing Sheets

FOREIGN PATENT DOCUMENTS

| | | | |
|---|---|---|---|
| DE | 198 06 914 | C2 | 9/1999 |
| EP | 0 762 541 | A2 | 3/1997 |
| EP | 0 812 027 | A2 | 10/1997 |
| EP | 0 591 049 | B1 | 3/1998 |
| EP | 0 877 444 | A1 | 11/1998 |
| WO | WO 99/54960 | | 10/1999 |
| WO | WO/01/19101 | A1 | 3/2001 |
| WO | WO 01/56186 | A2 | 8/2001 |
| WO | WO 01/58047 | A1 | 8/2001 |
| WO | WO 02/052677 | | 7/2002 |

OTHER PUBLICATIONS

Mahmondi, M. et al., "Adaptive Sector Size Control in a CDMA System Using Butler Matrix," pp. 1355-1359 (1999 IEEE).

* cited by examiner

CALIBRATION DEVICE FOR AN ANTENNA ARRAY, ANTENNA ARRAY AND METHODS FOR ANTENNA ARRAY OPERATION

FIELD

The technology herein relates to a calibration device for an antenna array, to an associated antenna array and to methods of operating such an antenna array. Such an antenna array is intended in particular for mobile radio, in particular for base stations for mobile radio transmission.

BACKGROUND AND SUMMARY

An antenna array of the generic type described herein typically has two or more primary antenna elements, but at least two antenna elements which are arranged alongside one another and one above the other, thus resulting in a two-dimensional array arrangement. These antenna arrays, which are also known by the term "smart antennas," are also used, for example, for target tracking (radar) in the military field. The expression "phased array antenna" is also frequently used in these applications. Recently, however, these antennas are being increasingly used for mobile radio purposes as well, particularly in the frequency bands from 800 MHz to 1000 MHz, and from 1700 MHz to 2200 MHz.

The development of new primary antenna element systems has now also made it possible to design dual-polarized antenna arrays, in particular with polarization alignments of +45° and −45° with respect to the horizontal and vertical.

Irrespective of whether they are fundamentally dual-polarized antenna elements or only single-polarized antenna elements, antenna arrays such as these can be used to determine the direction of the incoming signal. At the same time, however, the emission direction can also be changed, that is to say selective beam forming is carried out, by appropriate adjustment of the phase angles of the transmission signals which are fed to the individual columns.

This alignment of the emission direction of the antenna can be provided by electronic beam swiveling, that is to say by varying the phase angles of the individual signals by suitable signal processing. It is also possible to use suitably designed passive beam forming networks for this purpose. The use of active phase shifters or phase shifters which can be driven by control signals in these feed networks is also known as a means for varying the emission direction. A beam forming network such as this may, for example, be in the form of a so-called Butler matrix which, for example, has four inputs and four outputs. Depending on which input is connected, the network produces a different but fixed phase relationship between the antenna elements in the individual dipole rows. An antenna design such as this with a Butler matrix is disclosed, for example, in prior art U.S. Pat. No. 6,351,243.

All the arrangements that have been mentioned for beam forming are subject to the problem, however, that the phase angle of the individual signals which are fed to the individual primary antenna elements depends on the length of the connecting cable. Since this may often be relatively long—particularly at exposed locations—the phase angle of the antenna generally needs to be calibrated by a calibration process that takes the connecting cable into account. Active electronic components in the individual feed lines, such as transmission or reception amplifiers are, of course, also likewise included in the calibration process.

With electronic components such as these, calibration is often required as a result of component tolerances and temperature sensitivity of the group delay time.

One specific problem relates to the use of upstream Butler matrices for direction forming. In this case, calibration is very complicated, since the phase angle downstream from the Butler matrix is not uniform and, furthermore, two or more primary antenna elements of the antenna normally receive a portion of the signal.

No appropriate calibration methods for appropriately optimized setting of a desired phase angle for the individual antenna elements are known, particularly for dual-polarized antennas.

Methods are also known in which individual elements of a vertically arranged antenna array are each fitted with probes that are connected to the dipoles. Antennas such as these are used, for example, for aircraft radio. The probes that are used in this case are used to verify that each dipole is receiving the appropriate power. The overall level is thus detected and measured by connection to one output. If a dipole is not receiving sufficient power, this defect is thus identified quickly, since the overall level then changes. Since all the primary antenna elements are interconnected by means of a common feed network, the phase angle or the delay time between the probe output (monitor output for aircraft radio antennas) and the input of the antenna is of only secondary importance.

An arrangement such as detects the power. Differentiated evaluation of the phase of the individual primary antenna elements is neither possible nor necessary in systems such as these since they comprise only a rigid array arrangement, with the elements connected to one another in a fixed manner and whose main beam direction is not varied by swiveling or switching.

U.S. Pat. No. 5,644,316 discloses an active phase variation device for an antenna, in which a coupling device is provided upstream of the antenna array. The coupling device is followed by N parallel-connected transmission paths, which each have a phase variation device and an amplitude variation device via which, on the output side, an antenna element that is associated with the relevant path is driven. In order to carry out appropriate calibration, the individual paths are measured successively, with a probe that is provided on the output side being associated with each relevant antenna element. The transmission signal which is supplied via the relevant path to the antenna element is detected via the probe and is likewise supplied to an evaluation device. By evaluation of the transmission signal that is tapped off on the input side in comparison with the transmission signal that is received via the probe, the phase and amplitude variation device which is provided in the respective path being measured can be driven appropriately via this respective path. A calibration device which is comparable to this extent has been disclosed in U.S. Pat. No. 6,046,697. In this apparatus as well, a specific signal is preferably supplied via the individual signal paths to an antenna element which is associated with the individual signal paths, in order to use a probe, which is fitted in the near field of the antenna element, to detect a phase angle signal. This can be used to drive the input side of a phase control device, via which the signal is supplied to the relevant antenna element. Instead of a probe device which can be positioned differently, it is also possible to provide coupling devices, which are then associated with each individual antenna element. The coupling devices can be connected and disconnected successively via the switching device.

A method and an apparatus for calibration of an antenna array have also been disclosed in DE 198 06 914 C2. In this exemplary embodiment as well, each antenna element has an associated directional coupling device, via which a signal can in each case be emitted from the relevant signal path. For calibration purposes, test signals are in each case sent successively to an individual antenna element, and a signal value is emitted via the directional coupler. The directional couplers are followed by a power splitter. The signal which is supplied to an individual antenna element during the calibration process is in consequence emitted via the relevant directional coupler, and is passed via the power splitter to its central port. The central port is connected to a reflection termination. The transmission signal component is reflected on this reflection section, and is split into signal elements with the same amplitude and phase at the branching ports, with the number of branching ports being the same as the number of transmission or reception paths. The individual signal elements which are derived from the transmission signal are now injected via the directional couplers into the individual reception paths. The signal elements which are produced at the outputs of the reception paths and received by the beam forming network are evaluated by a control device. This allows an overall transmission factor to be determined for each individual path which leads to an antenna element, which allows a weighting process to be carried out and, in the end, allows phase variation.

The overall complexity in this case is also considerable, since each antenna column must have an associated directional coupling device. A coupling device is required in this case since, as mentioned, on the one hand one signal element is masked out via this in each individual signal path and, on the other hand, a signal element which arrives via the reflection device and the power splitter must be injected once again in each individual path via the directional couplers that are provided, in order to carry out the appropriate evaluation.

The present exemplary illustrative non-limiting implementation provides a calibration device for an antenna array, as well as an associated antenna array, which is of simple construction and at the same time has advantages over the prior art. The antenna array according to the exemplary illustrative non-limiting implementation is in this case preferably intended to be a dual-polarized antenna array. The associated calibration device should therefore preferably be suitable for a dual-polarized antenna array of this type.

The calibration device and antenna array according to the exemplary illustrative non-limiting implementation are distinguished by numerous simplifications.

An exemplary illustrative non-limiting implementation now makes it possible to provide fewer probes or coupling devices for each column of an antenna array having two or more antenna elements arranged one above the other, that are provided in the relevant column of the antenna array with antenna elements which are arranged one above the other. When N antenna elements or coupling devices are arranged one above the other in each case, the exemplary illustrative non-limiting implementation makes it possible without any problems to provide, for example, only N/2 fixed probes per column.

In an exemplary illustrative non-limiting implementation, once again with N antenna elements arranged one above the other, only a single fixed probe is required per column, via which both polarizations can be measured. If, for example, a coupling device in the form of a directional coupler is used, two coupling devices are preferably used for a dual-polarized antenna element (i.e., one coupling device for each polarization).

According to the exemplary illustrative non-limiting implementation, it is possible to provide only two fixed probes (or two fixed coupling devices for a single-polarized antenna array or, for example, two pairs of fixed coupling devices for a dual-polarized antenna array) for an antenna array having, by way of example, four columns, with these probes preferably being arranged symmetrically with respect to the vertical central plane of symmetry. It is thus possible, for example, to provide in each case one probe (or in each case one coupling device in the case of a single-polarized antenna array or in each case one pair of coupling devices for a dual-polarized antenna array) for the two outermost columns or, for example, to provide in each case one probe (or, once again, the coupling device in a corresponding manner) for the two central columns.

In the case of an exemplary illustrative non-limiting beam forming network which is preferably in the form of a Butler matrix, it is possible to use only one, but preferably at least two, fixed probes, which are each associated with one antenna element in a different column of the antenna array. The measurement results obtained in this way make it possible to determine a phase relationship between all the antenna elements. In the end, this is possible because the individual antenna elements (their arrangement as well as the length of the feed cables for a connection point on the input side) can be measured and matched as far as the antenna elements such that all the antenna elements also emit with a fixed predetermined phase relationship with respect to one another when using a beam forming network, for example, in the form of a Butler matrix. If any phase shifts occur as a result of upstream beam forming networks or as a result of different upstream cable lengths, then the phase shifts caused by them act on all the antenna elements so that, in the end, a shift in the phase angle can be detected via only a single fixed probe or, possibly, only by a single coupling device that is associated with an antenna element. This is true even when a down tilt angle is preset or provided for the large number of antenna elements in the antenna array.

The test signals for the calibration process are, in one exemplary illustrative non-limiting implementation, not tapped off via coupling devices such as directional couplers, but rather via probes which may be provided in the near field. In this case, it has been found to be particularly advantageous that only a single probe is required for both polarizations, even for dual-polarized antenna elements. The probes may be arranged such that they are positioned directly on the reflector plate of an antenna array, such that the vertical height extent measured from the plane of the reflector plate is less than the position and arrangement of the antenna elements, for example of the dipole structures for the antenna elements. The calibration device and antenna array according to the exemplary illustrative non-limiting implementation, may also be formed from patch antenna elements or from combinations of patch antenna elements with dipole structures.

For example, in one exemplary illustrative non-limiting implementation, the small number of probes which are provided for each antenna array column or, for example, a single probe that is provided for a number of columns, is or are preferably arranged on the uppermost or lowermost antenna element, or on the uppermost or lowermost dipole antenna element structure. A corresponding situation occurs when coupling devices are used instead of the probes. The probes are preferably arranged in a vertical plane at right angles to the deflector plane and running symmetrically through the dual-polarized antenna element structure. However, in principle, a lateral offset is also possible.

The preferably at least two capacitive or inductive probes or the coupling devices which may be used are permanently connected to one another by means of a combination network. This combination network is preferably designed such that the group delay time from the input of the respective column to the output of the combination network has an approximately equal magnitude for all the antenna inputs (at least with respect to one polarization for dual-polarized antennas), and over the entire operating frequency band.

A further improvement can also be achieved by the combination network containing lossy components. This is because these components contribute to reducing resonances.

The antenna array according to the exemplary illustrative non-limiting implementation and/or the calibration device according to the exemplary illustrative non-limiting implementation are/is suitable for calibration of an antenna array in which the antenna elements and groups of antenna elements which are arranged in the individual columns are normally each driven via their own input. An appropriate phase calibration can thus be carried out by means of the calibration device according to the exemplary illustrative non-limiting implementation, in order to obtain a desired beam shape. In this case, it is likewise possible to provide for the main beam direction to be swiveled, particularly in the azimuth direction (or else, of course, in the elevation direction). The antenna array according to the exemplary illustrative non-limiting implementation and the calibration device according to the exemplary illustrative non-limiting implementation may, however, also be used just as well if the antenna array is preceded by a beam forming network, for example in the form of a Butler matrix.

The phase angle of the transmission from the input of the individual columns or of the antenna inputs is admittedly preferably of the same magnitude but, in practice, the phase angle (or the group delay time) is subject to discrepancies from the ideal phase angle to a greater or lesser extent, due to tolerances. The ideal phase angle is that for which the phase is identical for all the paths, to be precise even with respect to the beam forming. The discrepancies to a greater or lesser extent which are due to tolerances occur additively as an offset or else as a function of frequency, due to the different frequency responses. According to the exemplary illustrative non-limiting implementation, provision is in this case made for the discrepancies across all the transmission paths to be measured, preferably on the path from the antenna array or beam forming network input to the probe output, or from the input to the probe outputs, and preferably over the entire operating frequency band (for example during the production of the antenna). When using coupling devices, the transmission paths are preferably measured on the path between the antenna array or beam forming network input and the coupling output or coupling outputs. This data determined in this way is then stored in a data record. This data, which is stored in suitable form, likewise for example in a data record, can then be provided to a transmission device or to the base station in order then to be taken into account for producing the phase angle of the individual signals electronically. It has been found to be particularly advantageous, for example, to associate this data, or the data record that has been mentioned, with the corresponding data for a serial number of the antenna.

BRIEF DESCRIPTION OF THE DRAWINGS

These and other features and advantages will be better and more completely understood by referring to the following detailed description of exemplary non-limiting illustrative implementations in conjunction with the drawings of which.

DETAILED DESCRIPTION

Figure 1:
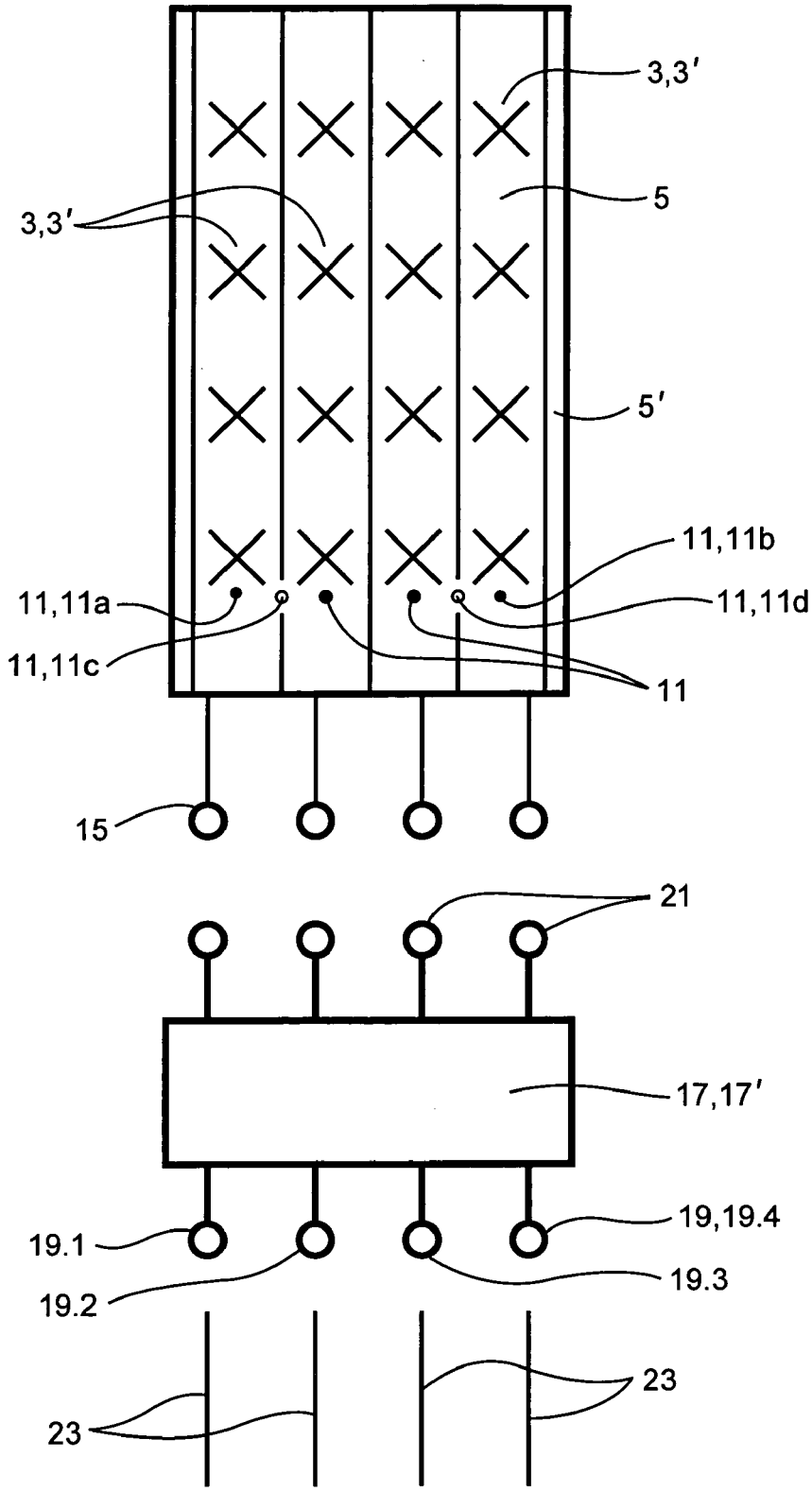
FIG. 1 shows a schematic plan view of an antenna array according to the exemplary illustrative non-limiting implementation, showing probes for a calibration device.

FIG. 1 shows a schematic plan view of an antenna array 1 which, for example, has a large number of dual-polarized antenna elements 3, which are arranged in front of a reflector 5.

In the illustrated exemplary illustrative non-limiting arrangement, the antenna array has columns 7 which are arranged vertically, with four antenna elements or antenna element groups 3 being arranged one above the other in each column.

Figure 2:
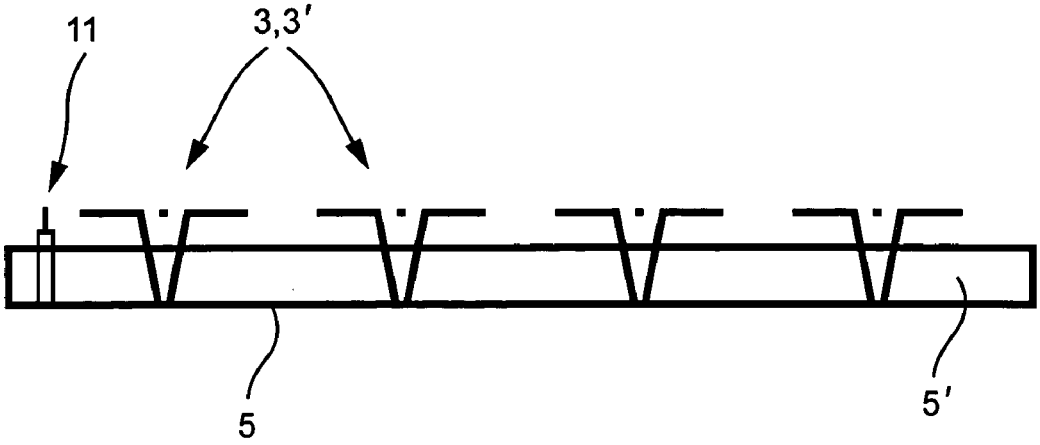
FIG. 2 shows an exemplary illustrative non-limiting schematic detail of a vertical cross-sectional illustration along a vertical plane through one column of the antenna array shown in FIG. 1.

Overall, four columns 7 are provided in the antenna array shown in FIGS. 1 and 2, in each of which the four antenna elements or antenna element groups 3 are positioned. The individual antenna elements or antenna element groups 3 need not be arranged at the same height in the individual columns. In the same way, for example, the antenna elements or antenna element groups 3 in two respectively adjacent columns 7 may be arranged such that they are offset with respect to one another by half the vertical distance between two adjacent antenna elements.

In the illustrated exemplary illustrative non-limiting arrangement, in each case one probe 11, which may operate inductively or capacitively, is in each case associated with the dual-polarized antenna element 3 arranged in the lowest position, for example, for the column 7 that is located furthest to the left and for the column 7 that is located furthest to the right. This probe 11 may be formed, for example, from a probe body which is arranged in the form of a column or in the form of a pin and extends at right angles to the plane of the reflector 5. The probes 11 may also be formed, for example, from inductively operating probes in the form of a small induction loop. Each probe is preferably arranged in a vertical plane 13 in which either the single-polarized antenna elements or the dual-polarized antenna elements 3 are arranged. The probes are preferably arranged in the near field of the associated antenna elements.

It can also be seen from the exemplary schematic in FIG. 2 that the probes 11 end underneath the dipole antenna elements 3' in the illustrated exemplary illustrative non-limiting implementation. These are capacitive probes in the illustrated exemplary non-limiting implementation.

In the case of a dual-polarized antenna as indicated in FIGS. 1 and 2, the antenna element 3 may be formed, for example, from cruciform dipole antenna elements or from dipole squares. Dual-polarized dipole antenna elements such as those which are known by way of example from WO 00/39894 are particularly suitable for this purpose. Reference is made to the entire disclosure content of this prior publication, which is included in the content of this application.

Figure 3:
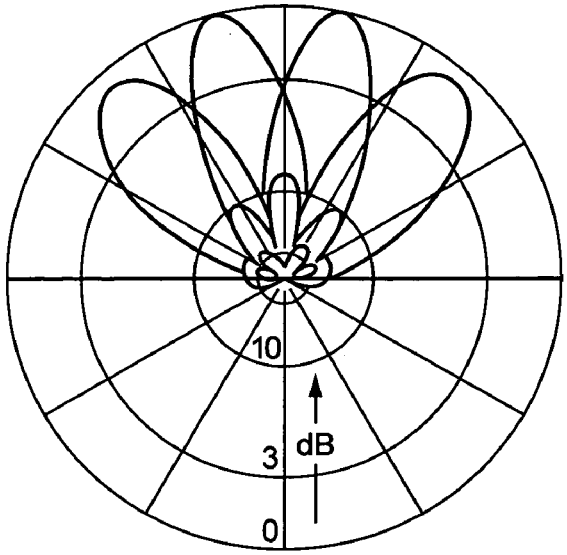
FIG. 3 shows an exemplary illustrative non-limiting illustration of four typical horizontal polar diagrams, which are produced by an antenna array by means of a 4/4 Butler matrix (that is to say a Butler matrix with four inputs and four outputs)

Finally, a beam forming network 17 which, for example, has four inputs 19 and four outputs 21 is also provided in FIG. 1. The four outputs of the beam forming network 17 are connected to the four inputs 15 of the antenna array. The number of outputs N need not be the same as the number of inputs n, that is to say, in particular, the number of outputs N may be greater than the number of inputs n. With a beam forming network 17 such as this, a feed cable 23 is then, for example, connected to one of the inputs 19, via which all the outputs 21 are fed in an appropriate manner. Thus, for example, if the feed cable 23 is connected to the first input 19.1 of the beam forming network 17, it is thus possible to produce a horizontal antenna element alignment of, for example, −45° to the left, as can be seen from the schematic diagram in FIG. 3. If, for example, the feed cable 23 is connected to the connection 19.4 on the extreme right, this results in a corresponding alignment of the main lobe of the polar diagram of the antenna array at an angle of +45° to the right. In a corresponding way, the feed cable 23 can be connected to the connection 19.2 or to the connection 19.3, the antenna array can be operated such that, for example, it is possible to swivel the beam through 15° to the left or to the right with respect to the vertical plane of symmetry of the antenna array.

With a beam forming network 17 such as this, it is thus normal to provide an appropriate number of inputs for different angular alignments of the main lobe of the antenna array, with the number of outputs generally corresponding to the number of columns in the antenna array. In this case, each input is connected to a large number of outputs, generally with each input being connected to all the outputs of the beam forming network 17.

The calibration apparatus which will be explained in detail in the following text is, however, also primarily suitable for an antenna array as shown in FIGS. 1 and 2, which has no upstream beam forming network, particularly in the form of a Butler matrix. In this case, the column inputs 15 of the antenna array are then fed via an appropriate number of separate feed cables or other feed connections. Just by way of example, in this context FIG. 1 shows four parallel feed lines 23, which are then connected directly to the column inputs 15 of the antenna array, omitting the beam forming network shown in FIG. 1.

Figure 4:
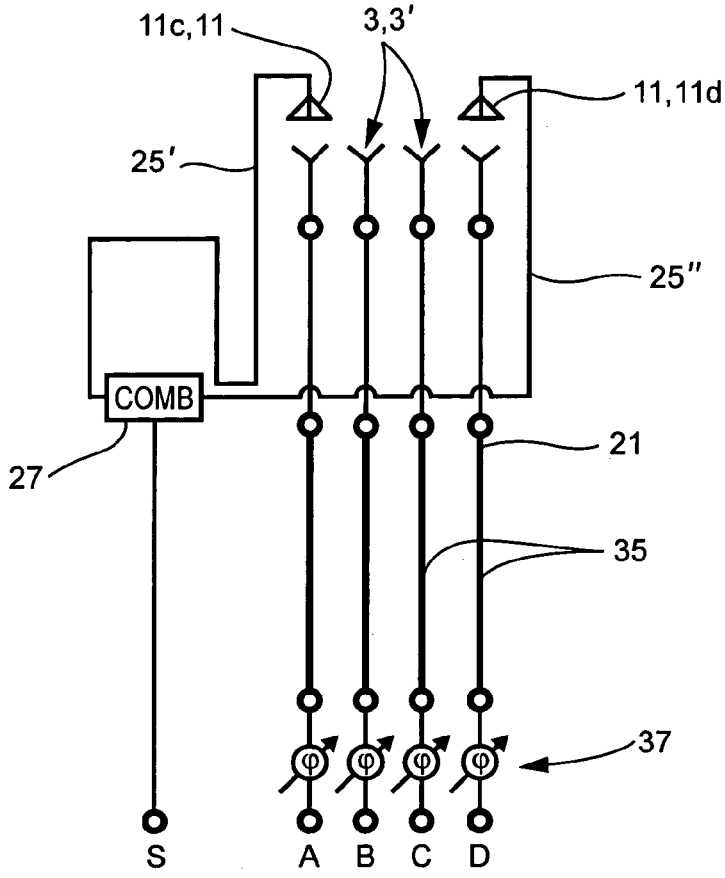
FIG. 4 shows a first exemplary illustrative non-limiting implementation of a calibration device using probes.

FIG. 4 now shows schematically the rest of the design and the method of operation of the calibration device, and of the antenna array. In this case, FIG. 4 shows schematically only four antenna elements 3, to be precise one antenna element for each column 7.

The exemplary illustrative non-limiting implementation shown in FIG. 4 will be used to describe a simplified implementation, in which an antenna array with four columns uses only two probes 11*c* and 11*d*. These probes are in this case arranged such that each probe is associated with one pair of columns 7 that are arranged alongside one another. In other words, the probe 11*c* is arranged in the area between the two columns on the left, and the probe 11*d* is arranged in the area between the two columns 7 on the right of the antenna array as shown in FIG. 1, which has four columns.

Thus, in the exemplary illustrative non-limiting implementation shown in FIG. 4, the two probes 11*c* and 11*d* are connected via respective signal lines 25' and 25" to a combiner 27 (Comb), whose output is connected to a connection S via a line 29.

In order to vary the phases on the supply lines 35 to the antenna array 1, a pilot tone, that is to say a known signal, is now passed, by way of example, to the supply line for the input A, in order to measure the absolute phase of the output S of the combination network 27 (Comb), that is to say, by way of example, a combiner. This can now also be done for the supply line at the inputs B, C and D.

If all the supply lines to the inputs A to D are (electrically) of exactly the same length (and can also otherwise be regarded as being identical), this results in the same absolute phase in each case at the output of the combination network S, that is to say there is no phase difference at the output S when the inputs A to D are connected alternately.

If any phase differences were to be found, these could be compensated for, for example, by means of phase adjustment elements 37, which are connected upstream of the respective inputs A to D. A corresponding electrical connecting line 23 would then, for example, be connected to the input A, B, C or D, that is to say to an input upstream of the respective phase compensation apparatus 37, in order to produce an appropriate alignment, as desired, of the main lobe with a different horizontal alignment. Finally, the phase adjustment elements 37 may also be formed from electrical line sections which, with a suitable length, are connected upstream of the individual inputs A to D, in order to provide phase compensation or phase adjustment in the desired sense.

The use of probes 11 offers the advantage that the corresponding calibration can be carried out both for single-polarized antenna arrays and for dual-polarized antenna arrays, using an appropriate number of probes.

Figure 5:
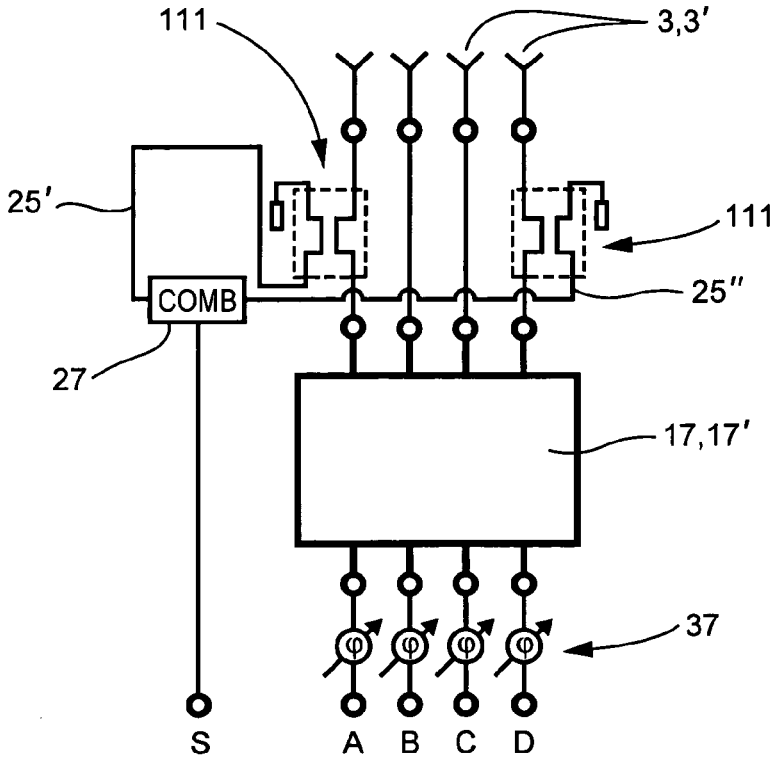
FIG. 5 shows an exemplary illustrative non-limiting calibration device, modified from that shown in FIG. 4, with a combination network using coupling devices instead of probes.

In contrast, FIG. 5 shows a comparable design, in which coupling devices 111 are used instead of probes 11. However, coupling devices 111 then allow calibration to be carried out only for single-polarized antenna arrays. In order to carry out a calibration for dual-polarized antennas using coupling devices, a design using appropriate pairs of coupling devices is then required, as is shown in FIG. 6 and as will be explained in the following text.

Figure 6:
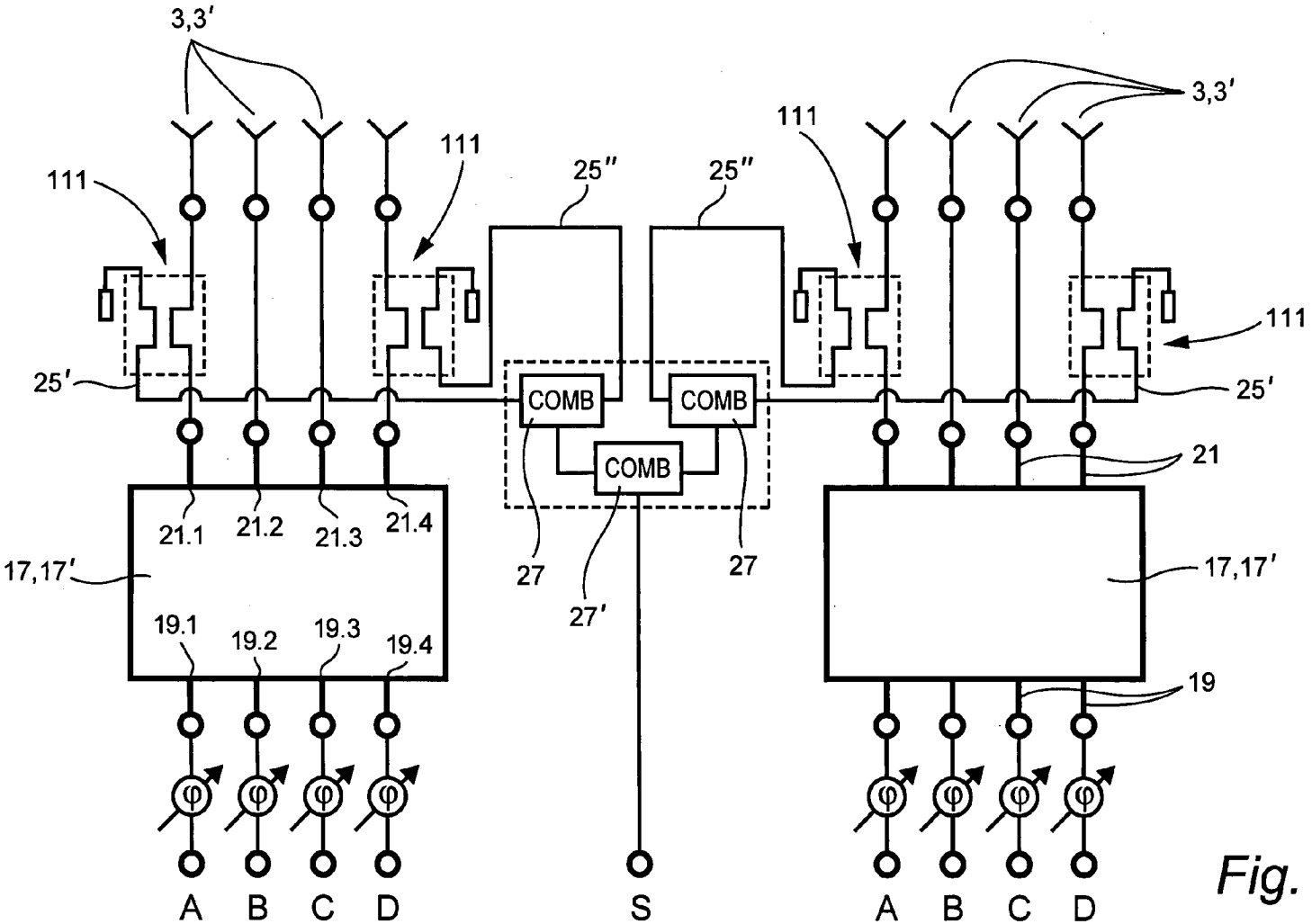
FIG. 6 shows an exemplary illustrative non-limiting implementation, extended from that shown in FIG. 5, using coupling devices for a dual-polarized antenna array.

The following text refers to FIG. 6, in which a calibration device for an antenna array is described, with the antenna array operating, for example, in conjunction with a beam forming network, preferably in the form of a Butler matrix. This beam forming network may preferably be integrated in the antenna array.

The beam forming network 17 may, for example, be a known Butler matrix 17' whose four inputs A, B, C and D are each connected to the outputs 21 via which the antenna elements 3 are fed via lines 35.

By way of example, two probes 11 which are as identical as possible and which each receive a small proportion of the respective signals are now provided at the two outputs 21.1 and 21.4 (or, as an alternative to this, at the two outputs 21.2 and 21.3). The emitted signals are added in the combination network 27 which has been mentioned, that is to say a so-called combiner (Comb), for example. The result of the emission of the signals and of the addition can also be measured via an additional connection on the combination network itself.

FIG. 6 shows the case of an antenna array with dual-polarized antenna elements 3, in which calibration can be carried out using a combination network which operates with coupling devices 111, for example directional couplers 111, rather than with probes 11. As can also be seen from the FIG. 5 exemplary illustrative non-limiting implementation, the calibration network can be combined for phase adjustment of the supply lines. A combination such as this is worthwhile when, for example, the respective beam forming network 17, for example the so-called Butler matrix 17', can be provided on one board together with the couplers and combination networks, since this makes it possible to produce largely identical units (in each case coupler combination networks).

In comparison to FIG. 5, FIG. 6 shows the extension to dual-polarized antenna elements with a beam forming network, with the two outputs of the respective combination network 27' and 27", for example in the form of a combiner (Comb) likewise being combined with a downstream second combination network 28 in the form of a combiner (Comb), and being connected to the common output S. The combination network 27' is thus used to determine the phase angle at an antenna element with respect to one polarization, with the combination network 27" being used to determine the phase angle at a relative antenna element for the other polarization.

Merely for the sake of completeness, it should also be mentioned that, in principle, it would be possible to set the phase adjustment elements at the input of the beam forming network 17, that is to say by way of example the Butler matrix 17', such that only a single coupler is required at the output of each matrix, with the same phase nevertheless always being measured independently of the input A to D. In this case as well, the phase adjustment elements may comprise line sections which in principle are connected upstream, in order to vary the phase angle. A probe 11 may, of course, also likewise preferably be used instead of a coupling device 111, via which probe 11 the signals which are emitted from a dual-polarized antenna element can be received in both polarizations. Only one probe is thus in each case required for both polarizations.

Figure 7:
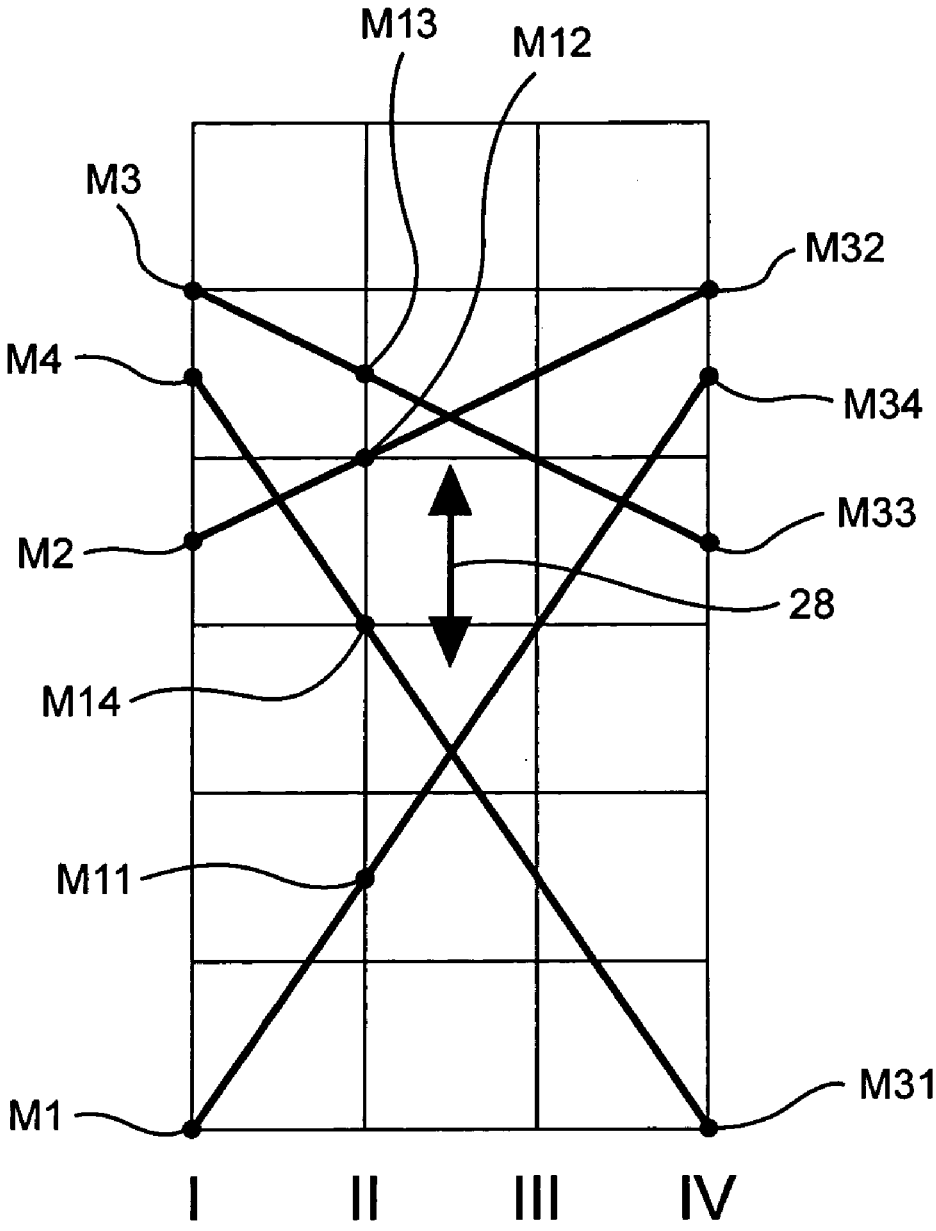
FIG. 7 shows an exemplary illustrative non-limiting diagram illustrating the derivation of the phase relationships between the individual antenna elements which are arranged in the various columns.

If, by way of example, only a single probe is used for an antenna array, that is to say only a single probe even for a dual-polarized antenna array, or if only a single coupling device is used for a single-polarized antenna array and two coupling devices (one coupling device for each polarization) are used for a dual-polarized antenna array, then phase adjustment can likewise be carried out, although with somewhat greater complexity. This is because, in the exemplary illustrative non-limiting implementation shown in FIG. 4, the relationship shown in FIG. 7 can also be implemented for the case of a dual-polarized antenna array using only a single probe (which, for example, is arranged in the dual-polarized antenna element 3' which is arranged in the lowermost position in column 1 in FIG. 1). Specifically, this allows the network points M1, M2, M3 and M4 to be measured and to be produced, depending on whether a connecting line 23 is connected to the input A, B, C or D. The fixed phase association with the antenna elements which are arranged in the individual columns 11 then makes it possible to determine the straight lines that are shown in FIG. 7, from which the exact phase angle can be derived. If the data from this diagram is evaluated appropriately, it is then possible to carry out appropriate phase adjustment on the input side, preferably even upstream of the beam forming network. However, the use of only one probe is feasible only for an antenna array having only two columns, or else an antenna array with two or more columns which is preceded by a beam forming network, for example in the form of a Butler matrix. This is because this is the only situation in which there is a predetermined phase relationship between the antenna elements in the individual columns.

If the correspondingly single probe or the corresponding single coupler pair were arranged, for example, in the second column, then it would be possible to determine corresponding measurement points M11, M12, M13 and M14, in which case the fixed phase relationship would likewise once again make it possible to place the appropriate straight lines through the points. This would once again make it possible to derive the same diagram as that shown in FIG. 7, in order to make it possible to carry out the appropriate phase adjustments and calibration processes.

If, however, in each case one probe is preferably used for the left-hand column and for the right-hand column in the preferred manner as shown in FIG. 1, by way of example (or a pair of coupling devices in the case of dual-polarized antennas), then it would in each case be possible to determine the measurement points M1 to M4 as well as the measurement points M31 to M34 in the diagram shown in FIG. 7, thus simplifying the entire evaluation process.

While the technology herein has been described in connection with exemplary illustrative non-limiting implementations, the exemplary illustrative non-limiting implementation is not to be limited by the disclosure. The exemplary illustrative non-limiting implementation is intended to be defined by the claims and to cover all corresponding and equivalent arrangements whether or not specifically disclosed herein.

The invention claimed is:

1. An antenna array comprising:

at least one feed connection;

a reflector;

plural antenna elements arranged in plural columns in front of the reflector, the plural columns having inputs;

a beam forming network being connected between the feed connection and the column inputs for N antenna elements arranged in a respective column, N being a natural number;

a calibration device comprising no more than N/2 coupling devices for said N antenna elements, said N/2 coupling devices being associated with only some of said N antenna elements, said coupling devices receiving a small amount of signal received or transmitted by the antenna array for use in antenna array calibration; and a combination network connected to the N/2 coupling devices, the combination network being designed such that the electrical delay from the input of the respective column to the output of the combination network is of approximately the same value for all the antenna inputs for a single-polarized antenna array or for at least one polarization for a dual-polarized antenna array, over the entire operating frequency band of the antenna array.

2. The antenna array according to claim 1, wherein the coupling devices emit from the near field of the antenna elements.

3. The antenna array according to claim 2, wherein the combination network is designed such that the group delay time from the input of the respective column to the output of the combination network is of approximately the same magnitude for all the antenna inputs for a singe-polarized antenna array or for at least one polarization for a dual-polarized antenna array, over the entire operating frequency band of the antenna array.

4. The antenna array according to claim 1, wherein the combination network has lossy components, which contribute to reducing resonances.

5. The antenna array according to claim 1, wherein, for a dual-polarized antenna array, the one or more coupling devices which are provided are each suitable for receiving a signal for both polarizations.

6. The antenna array according to claim 2, wherein one probe or one coupling device, or a pair of coupling devices is or are provided for only one antenna element per column.

7. The antenna array according to claim 2, wherein only one coupling device, or only one pair of coupling devices is or are provided in each case for only some of the columns, and is or are associated with at least one antenna element.

8. The antenna array according to claim 1, wherein the coupling devices lie on a vertical plane of symmetry, which passes through the antenna elements with respect to the antenna elements which are associated with it or them.

9. The antenna array according to claim 2, wherein, for an antenna array with four columns, at least two coupling devices or two pairs of coupling devices are provided, which are each associated with one antenna element, which is arranged in the two outer columns on the antenna array.

10. The antenna array according to claim 2, including, for an antenna array with four columns, two coupling devices or two pairs of coupling devices, which are each associated with one antenna element, and these antenna elements are arranged in the two inner columns of the antenna array.

11. The antenna array according to claim 2, wherein the coupling devices which are associated with one antenna element per column are arranged on the same height line.

12. The antenna array according to claim 1, wherein one probe is in each case provided for two adjacent columns of an antenna array, and has the same coupling loss.

13. The calibration device of claim 1, wherein the antenna array has two or more antenna elements arranged in two or more columns spaced apart in a vertical direction.

* * * * *